US005524762A

United States Patent [19]

Shafran et al.

[11] Patent Number: 5,524,762

[45] Date of Patent: Jun. 11, 1996

[54] DISPOSABLE LITTER BAG SYSTEM

[76] Inventors: Barry W. Shafran, 9 Carluke Crescent, Willowdale, Ontario, Canada, M2L 2H7; Charles G. Shepherd, 1008 Westdale Raod, Oakville, Ontario, Canada, L6L 5A2

[21] Appl. No.: 365,733

[22] Filed: Dec. 29, 1994

[51] Int. Cl.[6] ..... B65D 1/34

[52] U.S. Cl. ..... 206/554; 248/95; 248/99; 248/101; 383/22; 383/79; 383/92

[58] Field of Search ..... 206/387.11, 554; 248/95, 99, 100, 101; 383/22, 33, 78, 79, 92

[56] References Cited

U.S. PATENT DOCUMENTS

| | | | |
|---|---|---|---|
| 3,126,094 | 3/1964 | Arnold et al. | 206/554 |
| 3,707,271 | 12/1972 | Sanchez et al. | 248/101 |
| 3,912,208 | 10/1975 | Grenetier | 248/99 |
| 4,322,048 | 3/1982 | Vollman | 248/101 |
| 4,381,836 | 5/1983 | Rivkin et al. | 206/387.11 |
| 4,759,442 | 7/1988 | Gregerson et al. | 206/387.11 |
| 4,932,560 | 6/1990 | Roen | 248/95 |
| 4,983,047 | 1/1991 | Netto | 383/79 |
| 4,998,694 | 3/1991 | Barteaux | 248/100 |
| 5,119,968 | 6/1992 | Palmer | 206/554 |
| 5,309,698 | 5/1994 | Haseman | 206/554 |

*Primary Examiner*—David T. Fidei
*Attorney, Agent, or Firm*—Mark B. Eisen

[57] ABSTRACT

The invention provides a disposable litter bag system comprising a holder with a clip for holding a bundle of tear-off bags. Each bag is provided with a flap adjacent to a top opening in the bag having at least one flap opening for insertion therethrough of engaging tabs projecting from the clip. The clip has opposed jaws hingedly connected together, with engaging stops projecting from one jaw and a receiving channel formed in the second jaw for detachably lodging the engaging stops therein. The holder preferably comprises a pair of flexible straps extending through the clip which can be trapped in the clearance between the panels of an automobile cabin, for example the glove compartment.

13 Claims, 4 Drawing Sheets

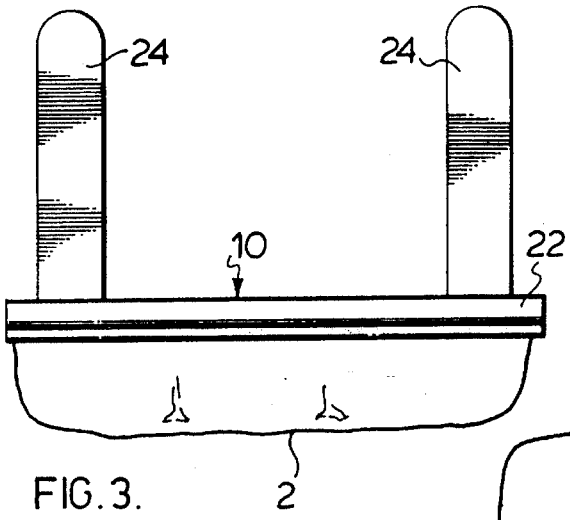
FIG. 3.
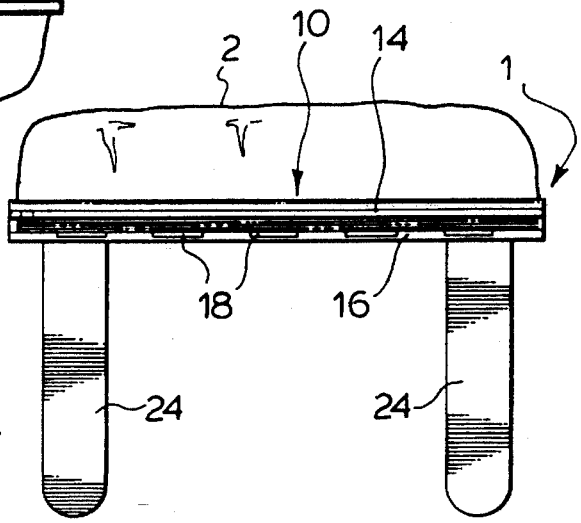
FIG. 4.
FIG. 5.
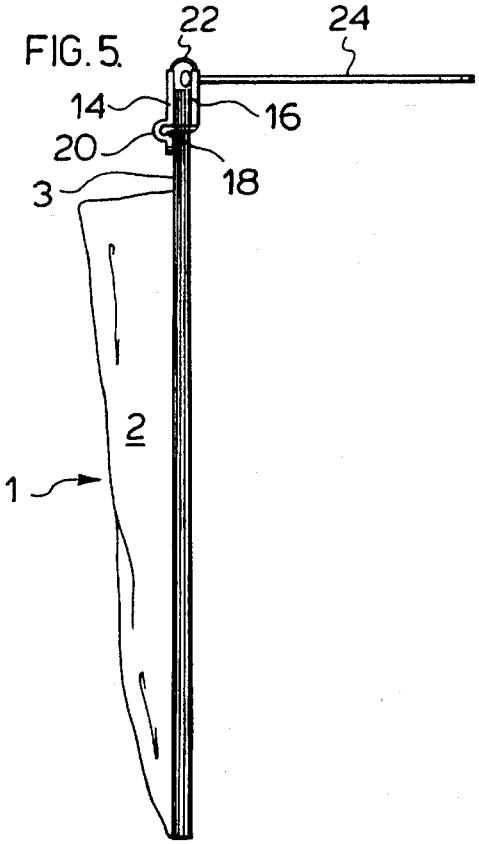
FIG. 6.
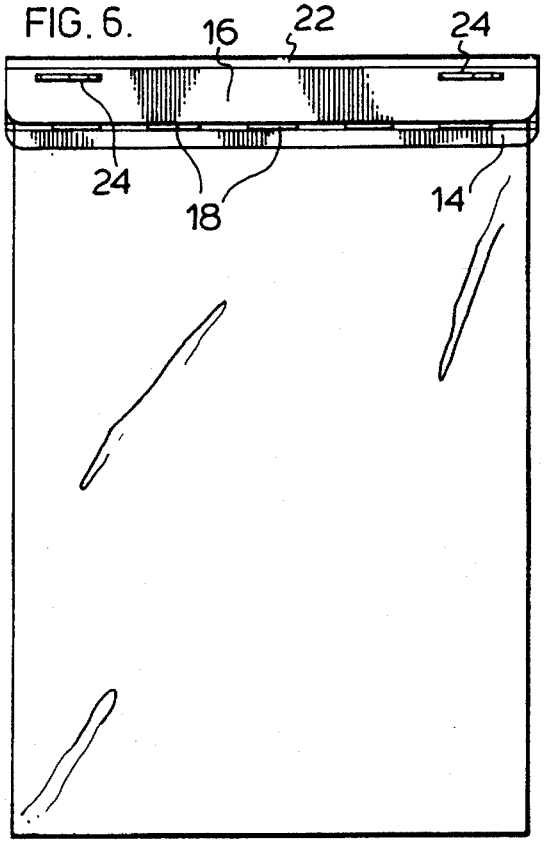

DISPOSABLE LITTER BAG SYSTEM

FIELD OF THE INVENTION

This invention relates to disposable containers. In particular, this invention relates to a holder for disposable trash bags which can be conveniently mounted for use in a confined space such as the cabin of an automobile.

BACKGROUND OF THE INVENTION

Disposable plastic trash bags are commonly used in residential and commercial premises, as a convenient means of collecting and disposing of garbage. Plastic trash bags are lightweight and waterproof, and because they are flexible they take up little space, which makes for easy storage prior to use.

Many different types of holders have been developed for holding plastic trash bags in convenient positions and locations, however all suffer from the problem that they occupy a lot of space—generally as much space as a filled trash bag—and as such are unsuitable for use in a confined space such as the cabin of an automobile. Moreover, conventional trash bag holders are either free-standing or mount to a vertical surface with screws, which also makes them unsuitable for use in the cabin of an automobile, which is in motion much of the time and in which sturdy interior panels capable of holding screws are scarce.

SUMMARY OF THE INVENTION

The present invention overcomes these disadvantages by providing a holder for disposable trash bags which is readily mounted on a closable panel in the cabin of an automobile, and trash bags adapted to be clipped to the holder. The holder is slim and unobtrusive, and is designed to hold a bundle of trash bags which tear away, one by one, after use. The holder may be made to match the color of the automobile interior, and can be unclipped and stowed away when not in use.

The present invention thus provides a holder for a bundle of bags, each bag being provided with a flap adjacent to a top opening in the bag, each flap being provided with at least one flap opening for insertion of engaging means therethrough, the holder comprising a clip, comprising first and second jaws hingedly connected together, engaging means projecting from the rear jaw, receiving means in the front jaw for detachably lodging the engaging means therein, and means for mounting the holder, wherein when the engaging means is inserted through the flap openings the bundle of bags is retained in the clip.

The invention further provides, in combination, a bundle of bags, each bag being provided with a flap adjacent to a top opening in the bag, each flap being provided with at least one flap opening for insertion of engaging means therethrough, and a holder comprising a clip, comprising first and second jaws hingedly connected together, engaging means projecting forwardly from the first jaw, receiving means in the second jaw for detachably lodging the engaging means therein, and means for mounting the holder, wherein when the engaging means is inserted through the flap openings the bundle of bags is retained in the clip.

The invention further provides a flexible plastic bag having a top opening, a flap extending from a wall of the bag adjacent to the top opening, and at least one opening through the flap for attachment to a holder.

BRIEF DESCRIPTION OF THE DRAWINGS

In drawings which illustrate by way of example only a preferred embodiment of the invention, FIG. 3 is a top plan view, FIG. 4 is a bottom plan view, FIG. 5 is a side elevation, FIG. 6 is a rear elevation.

DETAILED DESCRIPTION OF THE INVENTION

Figure 1:
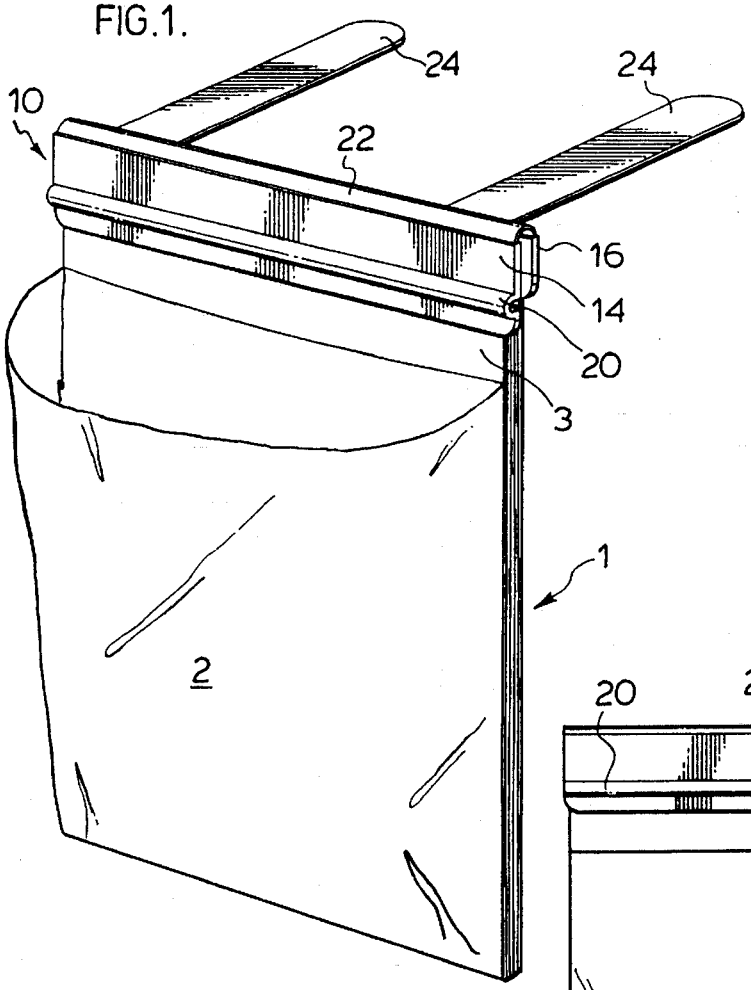
FIG. 1 is a perspective view of a bag holder embodying the invention with bags clipped therein.
Figure 2:
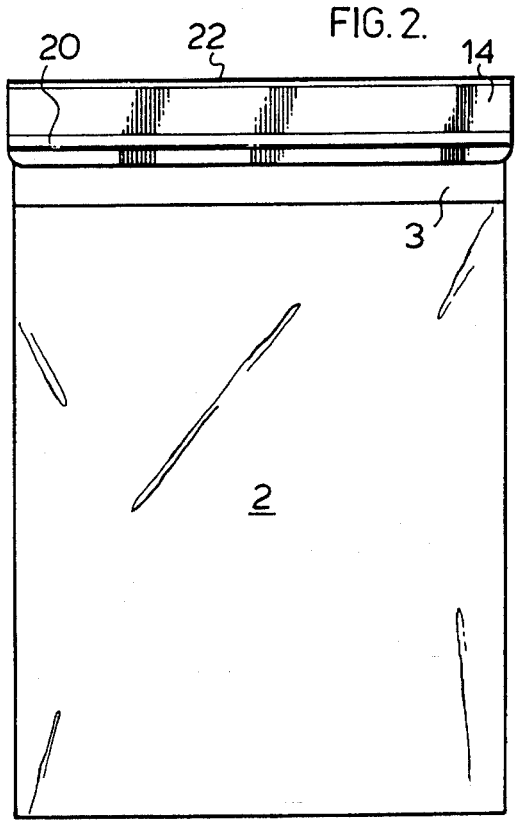
FIG. 2 is a front elevation.

Referring to FIGS. 1–6, the invention comprises a bag holder 10 to which a bundle of bags 1 are attached. Each bag 1 is composed of conventional flexible plastic and is provided with a rear flap 3 that extends beyond the main body of the bag 1. Thus, the bag 1 can be suspended by the rear flap 3 and the opening 5 in the top of the main body of the bag 2 is accessible, as shown in FIG. 1.

Figure 7:
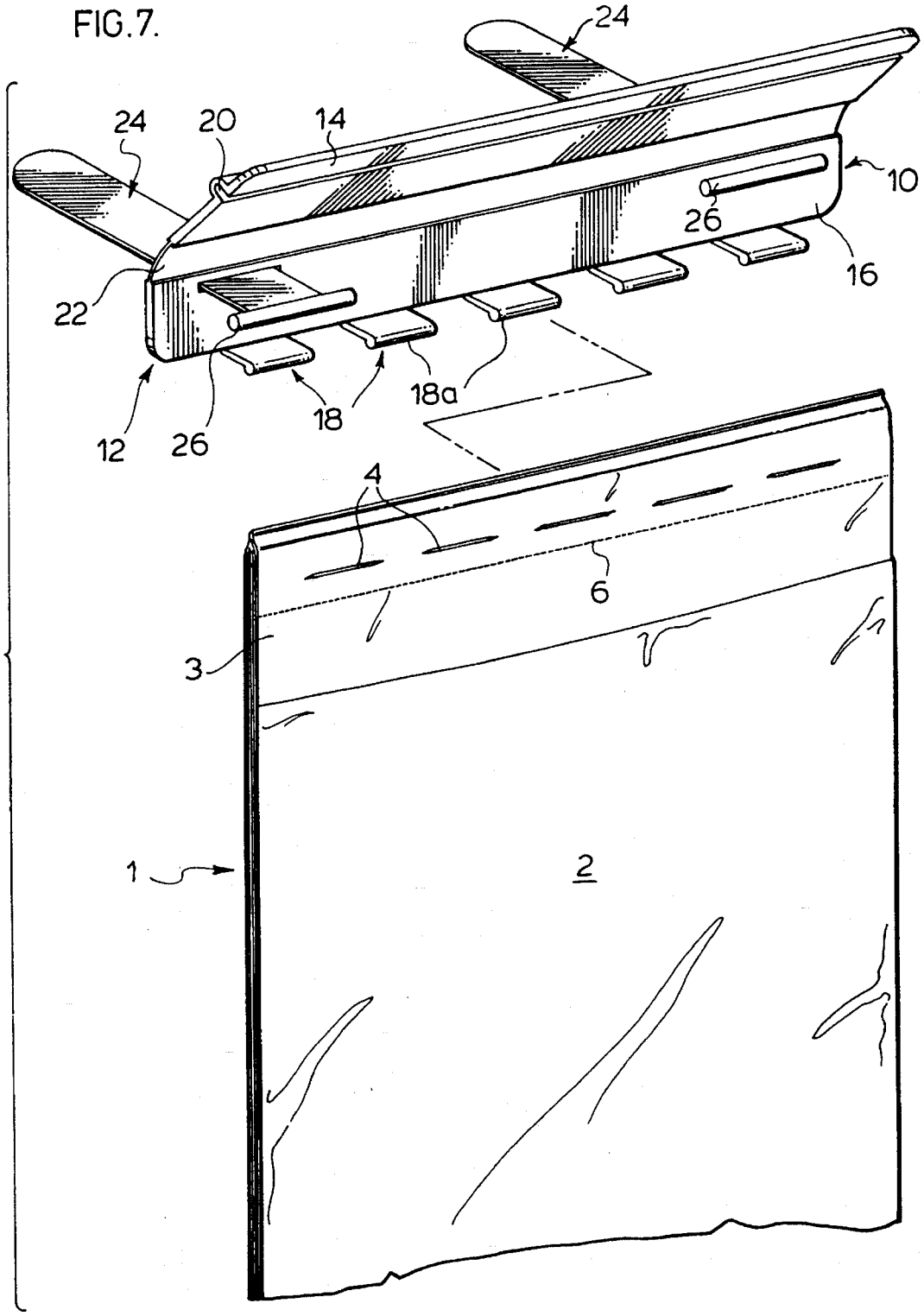
FIG. 7 is a partially exploded perspective view.
Figure 8:
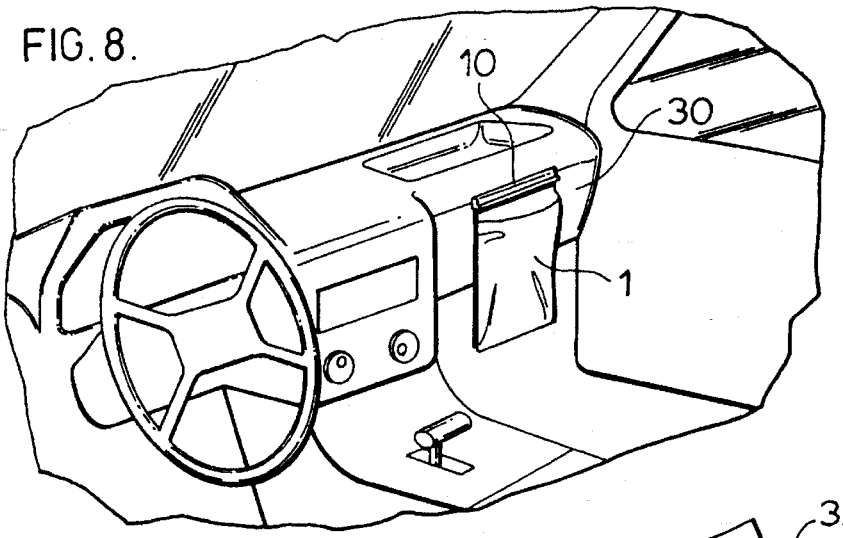
FIG. 8 is a perspective view of the bag holder mounted in the cabin of an automobile.

The flap 3 is provided with openings preferably in the form of slots 4 adjacent to an upper edge of the flap 3, as seen in FIG. 7, to secure the bag 1 to the holder 10 as described below. A perforated line 6 extends across the rear flap 3 immediately beneath the slots 4, to facilitate tearing the bag 1 off of the holder 10 for disposal. Preferably a bundle of bags 1 is formed by heat sealing or otherwise joining the top edges of the flaps 3 of a bundle of bags 1.

Figure 9:
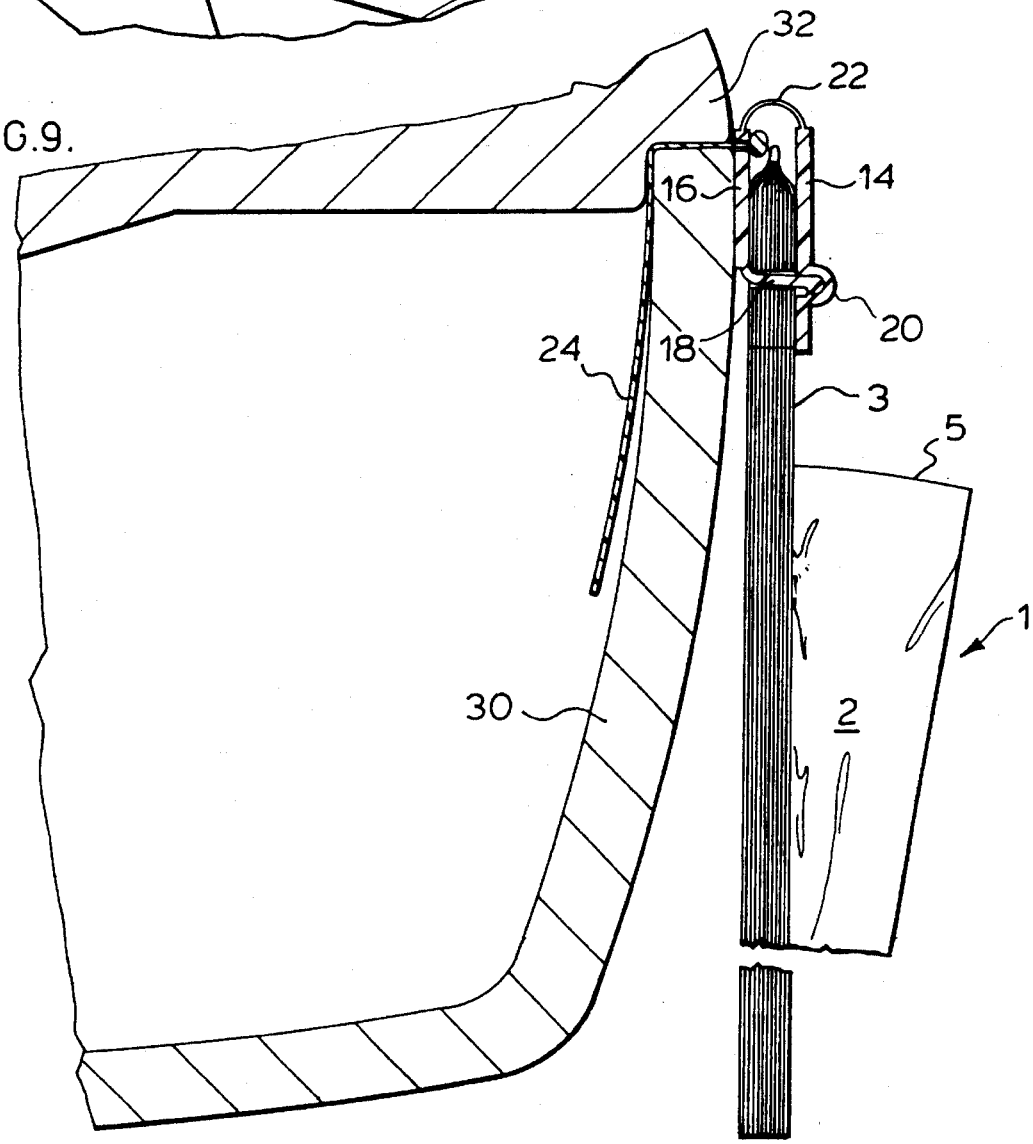
FIG. 9 is a cross-section of FIG. 8.

The holder 10 comprises a plastic clip 12 having a front jaw 14 and rear jaw 16, best seen in FIG. 7. Engaging means comprising a series of engaging tabs 18 projects forwardly from the lower edge of the rear jaw 16. Each engaging tab 18 is provided with gripping means in the form of an enlarged end 18*a* for detachably lodging the engaging tabs 18 into receiving means comprising a channel 20 extending across the front jaw 14 of the clip 12, either frictionally in an interference fit relation or in a press fit relation, as shown in FIG. 9.

The jaws 14,16 of the clip 12 are relatively rigid, although if a press fit engagement between the engaging tabs 18 and the channel 20 is desired, the front jaw 14 must be flexible enough to permit the channel 20 to expand slightly to allow the enlarged ends 18a of the engaging tabs 18 to be inserted into the channel 20. The front jaw 14 is joined to the rear jaw 16 by a flexible hinge 22 formed by a web of plastic, preferably formed integrally with the front and rear jaws 14,16 but made thinner so as to be flexible, to allow repeated opening and closing of the clip 12 without breaking the hinge 22.

In the preferred embodiment a pair of flexible plastic mounting tabs 24 extends through openings in the rear jaw 16, for mounting the holder 10 in the manner described below. The mounting tabs 24 are each provided with stop means 26, preferably formed integrally therewith, to retain the mounting tabs 24 in the rear jaw 16 of the clip 12. Alternative mounting means such as velcro fasteners, adhesive tape or the like may also be used to mount the holder 10.

In use, a bundle of bags 1 is attached to the holder 10 by opening the clip 12 and inserting the engaging tabs 18 through the slots 4 in the flaps 3, the slots 4 being sized and spaced for this purpose. The clip 12 is then closed by swinging the front jaw 14 toward the rear jaw 16 and press-fitting the enlarged ends 18*a* of the engaging tabs 18 into the channel 20 in the front jaw 14, as can be seen in FIGS. 5 and 9. The bundle of bags 1 is thus held in the clip 12, and the clip 12 is held closed, by the engaging tabs 18.

The holder may be mounted by inserting the mounting tabs 24 into the clearance between a slightly open hinged panel, such as a glove compartment door 30, and an adjacent panel 32, and closing the hinged panel. The flexible mounting tabs 24 assume the shape of the crevice between the panels 30,32, as seen in FIG. 9, and are thus snugly held in place.

As noted above, when the holder 10 is so mounted the opening 5 in the front bag 1 of the bundle of bags 1 is accessible, as shown in FIG. 9. The bag may be conveniently used to collect trash or other materials, and when filled, removed by tearing along the perforated line 6, exposing the opening 5 of the next bag 1 in the bundle. When the last bag 1 in the bundle is torn away, the holder 10 can be refilled with a new bundle of bags 1 by prying the clip 12 open, removing the spent flap ends and inserting a new bundle of bags 1 as described above.

A preferred embodiment of the invention having been thus described, it will be apparent to those skilled in the art that certain modifications and adaptations may be made without departing from the scope of invention, as set out in the appended claims.

We claim:

1. A holder for a bundle of bags, each bag having closed side edges and a width defined therebetween and being provided with a flap adjacent to a top opening in the bag, each flap extending substantially across the width of the bag and being provided with openings elongated along the width of the bag for the insertion of engaging means therethrough and a perforated line for tearing the bag from the flap, the holder comprising a clip comprising first and second jaws extending along the width of the bag and hingedly connected together, engaging means projecting from the first jaw comprising a plurality of engaging tabs elongated along the width of the bag, receiving means in the second jaw for detachably lodging the engaging means therein, comprising a substantially continuous channel extending along the second jaw opposite to the engaging tabs, the engaging tabs including gripping means comprising enlarged ends which lodge in the receiving means in a press-fit relation, and means for mounting the holder, wherein when the engaging means is inserted through the openings and engaged to the receiving means the bundle of bags is retained in the clip.

2. The holder of claim 1 in which the channel is flexible such that the channel expands and closes around the enlarged ends of the engaging tabs as the enlarged ends are inserted into the channel, drawing the first and second jaws together.

3. The holder of claim 1 in which the first and second jaws are formed integrally with a flexible hinge portion therebetween.

4. The holder of claim 1 in which the means for mounting the holder includes at least one flexible mounting tab extending through one of the jaws.

5. In combination,

A bundle of bags, each bag having closed side edges and a width defined therebetween and being provided with a flap adjacent to a top opening in the bag, each flap extending substantially across the width of the bag and being provided with openings elongated along the width of the bag for the insertion of engaging means therethrough and a perforated line for tearing the bag from the flap, and a holder comprising a clip having first and second jaws extending along the width of the bag and hingedly connected together, engaging means projecting from the first jaw comprising a plurality of engaging tabs elongated along the width of the bag, receiving means in the second jaw for detachably lodging the engaging means therein, and means for mounting the holder, wherein when the engaging means is inserted through the openings and engaged to the receiving means the bundle of bags is retained in the clip.

6. The combination of claim 5 in which the engaging tabs include gripping means comprising enlarged ends which lodge in the receiving means in a press-fit relation.

7. The combination of claim 6 in which the receiving means comprises a substantially continuous channel extending along the second jaw opposite to the engaging tabs.

8. The combination of claim 7 in which the channel is flexible such that the channel expands and closes around the enlarged ends of the engaging tabs as the enlarged ends are inserted into the channel.

9. The combination of claim 6 in which the first and second jaws are formed integrally with a flexible hinge portion therebetween.

10. The combination of claim 6 in which the means for mounting the holder includes at least one flexible mounting tab extending through one of the jaws.

11. A holder for a bundle of bags, each bag having closed side edges and a width defined therebetween and being provided with a flap adjacent to a top opening in the bag, each flap extending substantially across the width of the bag and being provided with openings elongated along the width of the bag for the insertion of engaging means therethrough and a perforated line for tearing the bag from the flap, the holder comprising a clip comprising first and second jaws extending along the width of the bag and hingedly connected together, engaging means projecting from the first jaw comprising a plurality of engaging tabs elongated along the width of the bag including gripping means comprising enlarged ends which lodge in the receiving means in a press-fit relation, receiving means in the second jaw for detachably lodging the engaging means therein, comprising a channel which is flexible such that the channel expands and closes around the enlarged ends of the engaging tabs as the enlarged ends are inserted into the channel, thereby drawing the first and second jaws together., and means for mounting the holder, wherein when the engaging means is inserted through the openings and engaged to the receiving means the bundle of bags is retained in the clip.

12. The holder of claim 11 in which the receiving means comprises a substantially continuous channel extending along the second jaw opposite to the engaging tabs.

13. The holder of claim 11 in which the first and second jaws are formed integrally with a flexible hinge portion therebetween.

* * * * *